United States Patent [19]

Horstman et al.

[11] 4,368,890

[45] Jan. 18, 1983

[54] PADDLE GAME APPARATUS

[75] Inventors: John W. Horstman, Maple Grove; George L. Hanson, Minneapolis, both of Minn.

[73] Assignee: Global Games Unlimited, Inc., Minneapolis, Minn.

[21] Appl. No.: 252,590

[22] Filed: Apr. 9, 1981

Related U.S. Application Data

[63] Continuation-in-part of Ser. No. 142,346, Apr. 21, 1980, abandoned.

[51] Int. Cl.[3] ..... A63B 59/00; A63B 67/00

[52] U.S. Cl. ..... 273/328; 273/76; 273/DIG. 8

[58] Field of Search ..... 273/328, 318, 323, 326, 273/76, DIG. 6, DIG. 8

[56] References Cited

U.S. PATENT DOCUMENTS

| | | | |
|---|---|---|---|
| 1,189,921 | 7/1916 | Cory | 273/328 |
| 1,671,749 | 5/1928 | Spaulding | 273/328 |
| 1,964,232 | 6/1934 | Tromblee | 273/328 |
| 1,986,154 | 1/1935 | Marks | 273/76 |
| 2,761,685 | 9/1956 | Lashley | 273/DIG. 6 X |
| 3,078,099 | 2/1963 | Hyman | 273/328 |
| 3,921,978 | 11/1975 | Warren | 273/DIG. 8 X |

FOREIGN PATENT DOCUMENTS

| | | | |
|---|---|---|---|
| 20452 | of 1902 | United Kingdom | 273/76 |

OTHER PUBLICATIONS

*Flaghouse,* Spring 1980 Catalog, p. 127.

*Primary Examiner*—William H. Grieb
*Attorney, Agent, or Firm*—Merchant, Gould, Smith, Edell, Welter & Schmidt

[57] ABSTRACT

A paddle apparatus (10) for use in a paddle ball game is disclosed. The apparatus (10) includes a generally planar paddle member (14) mounted at one end of an elongated handle (20) or grasping member. At the opposite end of the handle (20) a frame (34) having a stocking member (40) suspended therefrom is mounted. In a preferred embodiment, the frame (34) and paddle member (14) can be substantially coplanar.

7 Claims, 6 Drawing Figures

FIG. 5
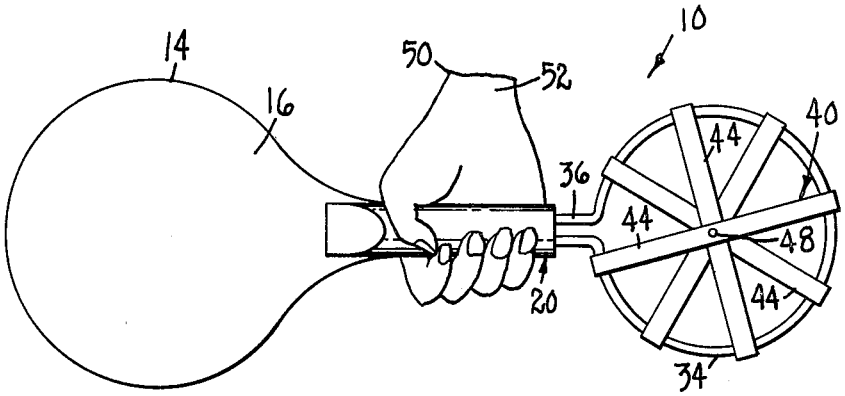
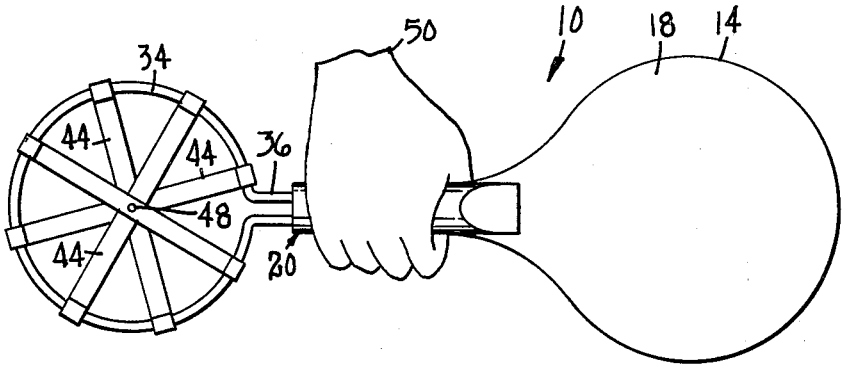
FIG. 6

PADDLE GAME APPARATUS

This application is a continuation-in-part of our copending application U.S. Ser. No. 142,346, filed Apr. 21, 1980, now abandoned.

TECHNICAL FIELD

The invention of this application relates to the field of athletic apparatus suitable for use in games for developing strategies, agility, and manual dexterity and skills. More specifically, it relates to paddle-type apparatus for use in such a game.

BACKGROUND OF PRIOR ART

Various games are known in the art which use a paddle-type structure. In its broadest definition, a baseball bat is a paddle in the sense that it is used to redirect the movement of a projectile, in this case a baseball. Other athletic implements, however, are more akin to paddles and are more appropriately so characterized. Squash rackets, hand ball rackets, and tennis rackets are forms of paddles. With these implements, however, the striking portion of the device comprises a meshwork of strung gut, nylon, or other appropriate material.

The athletic implement most frequently thought of as a "paddle" is the device usd in table tennis or Ping Pong. Such an implement is different than other "paddles" heretofore described in that its striking surface is solid and continuous and frequently covered with a spongy substance whereby more energy can be imparted to the Ping Pong ball when it is struck by the paddle.

All devices described to this point have as their objects, in use, to merely redirect the movement of the projectile being struck. In fact, frequently, the rules of the game preclude retention of the projectile at the surface of the implement. Other games, however, utilize apparatus designed to receive and hold the projectile impelled toward the user of the apparatus. Typical of this type of game are lacrosse and jai alai. The apparatus used in these two games are specifically designed so that the player can "catch" the ball and, thereafter, selectively redirect the motion of the ball in a direction desired. The same structure in the case of each of the lacrosse stick and the jai alai basket functions to both receive the projectile and to impel it outwardly again. Consequently, although skills are developed, the potential for maximization of skill development through use of those implements is more limited than it might be.

The invention of the present application provides a structure which affords greater flexibility in the development of manual dexterity and skills. It is designd to overcome some of the limitations hereinbefore described.

BRIEF SUMMARY OF THE INVENTION

The present invention is an atheltic implement suitable for use in various paddle games utilizing a ball or other projectile. The implement includes a paddle element whose function is to strikingly engage the projectile. Further included is apparatus for ensnaring the ball when the ball is impelled toward the user of the implement. The ensnaring means permits selective release of the ball therefrom by the user of the implement. The paddle means and ensnaring means are spaced from one another along an axis and are fixedly positioned with respect to one another. Handle means are provided to facilitate grasping of the instrument by the player/user. The handle means is integrated into the implement and fixedly positioned relative to the paddle means and ensnaring means.

In a preferred embodiment, the handle means or grasping member can be positioned between the paddle means and ensnaring means. The user of the apparatus can be afforded maximum control if the grasping means is made in the form of an elongated handle having an axis of elongation, wherein the axis of elongation coincides with the axis along which the paddle means and ensnaring means are spaced. Optimally, the paddle means and ensnaring means are mounted at opposite ends of the grasping member.

In one embodiment, the ensnaring means includes a frame and a stocking member suspended from the frame to define a flexible basket; the paddle means includes at least one planar surface. The implement can be assembled so that the planar surface and the frame of the basket are substantially coplanar. If desired, the paddle means can include a second paddle face extending generally parallel to, and facing in a direction opposite of, the first planar surface. In such a configuration, the paddle means esentially resembles a table tennis paddle.

Since the ensnaring means or basket is flexible in nature, a ball propelled toward the user of the implement can be ensnared within the basket by passing through the frame in either direction. The game player can, then, flip the ball out of the basket and return it to an opponent by striking it with the paddle portion of the implement. Because of the nature of the structure of the paddle means and ensnaring means in this embodiment, the catching and returning functions can be performed with the arm in either a supinated position, that is with the inner part of the forearm facing upwardly or outwardly, or in a pronated position, that is with the inner portion of the forearm facing downardly or inwardly.

The stocking member can be comprised of a plurality of nylon straps mounted, by opposite ends thereof, to the frame. The straps can be spaced angularly with respect to one another and can intersect each other proximate their centers. They can be dimensioned so that all will extend approximately the same distance on either side of the frame. If desired, they can be riveted together, or affixed by other means, at their point of intersection.

In certain embodiments, the frame can be made circular in shape. With the frame so shaped, each of the straps can be made approximately the same length.

When desired, the straps can be coated with a polyurethane material. By applying such a coating to the straps, they can be given some measure of rigidity. Consequently, the mere force of gravity will not cause the stocking member to pass through the frame. The stocking member can, therefore, when it extends on the side of the frame from which the ball is approaching, offer some measure of resistance to the ball. It can, thereby, serve a cushioning function as the user of the implement is catching the ball.

Thus, the apparatus provides a structure which cultivates manual dexterity and skills with the arm in both the supinated and pronated positions. Various other advantages and features of novelty which characterize the invention are pointed out with particularity in the claims annexed hereto and forming a part hereof. For a better understanding of the invention, however, and its advantages and objectives, reference should be made to the drawings which form a further part hereof and to the accompanying descriptive matter in which are illustrated and described in detail certain preferred embodiments of the invention.

BRIEF DESCRIPTION OF THE DRAWINGS

FIG. 5 is a top plan view illustrating the structure of the present invention as used wth the arm of the user in a supinated position; and FIG. 6 is a top plan view illustrating the structure of the present invention as used with the arm of the user in a pronated position.

DETAILED DESCRIPTION OF THE INVENTION

Figure 1:
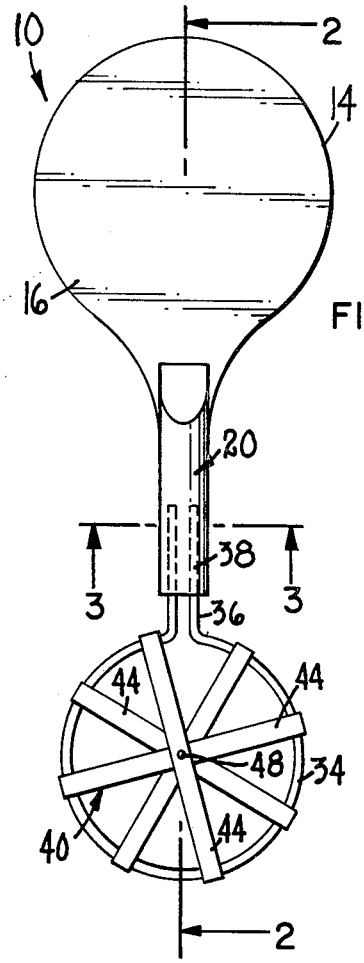
FIG. 1 is a top plan view of an embodiment in accordance with the invention of the present application.
Figure 2:
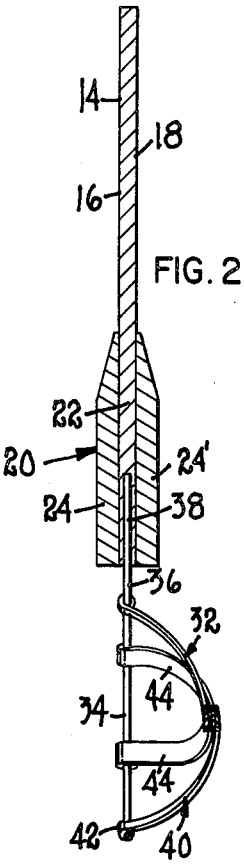
FIG. 2 is a sectional view taken along the line 2—2 of FIG. 1.
Figure 3:
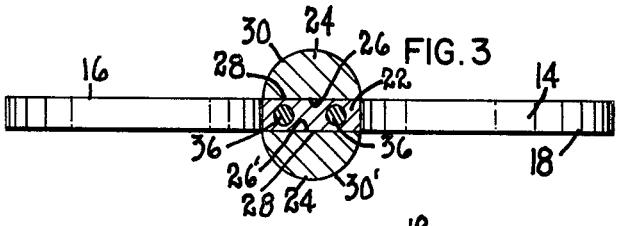
FIG. 3 is a sectional view taken along the line 3—3 of FIG. 1.

Referring now to the drawings wherein like numerals denote like elements throughout the several views, FIGS. 1 through 3 illustrate a preferred embodiment of an athletic implement, generally designated as 10, in accordance with the present invention. The implement 10 is suitable for use with any number of types of projectiles, but a ball 12 is particularly appropriate. The implement 10 includes a paddle member 14 having at least one planar surface 16. In certain embodiments of the apparatus, the paddle member 14 can be made so as to have a second planar surface 18 facing in a direction opposite that in which the first planar surface 16 faces. Typically, these two surfaces 16, 18, would be substantially parallel as with a table tennis paddle.

FIG. 1 shows a portion of the paddle member 14 by which a ball 12 used with the implement 10 would be struck as having a generally circular shape. It will, of course, be understood that this portion of the paddle member 14 can be modified to have one of any number of shapes. When a circular configuration is used, however, the diameter of the circular portion would typically be of a length substantially greater than the diameter of a ball 12 with which the implement 10 is used.

A grasping member or handle 20 is provided to enable the user of the implement 10 to maneuver the paddle member 14. The paddle member 14 is shown mounted at one end of the handle 20 by appropriate means. With the method illustrated in FIGS. 1 and 2, the handle 20 includes a central lamina 22 formed by an extension of the paddle member 14 and integrally formed therewith. The central lamina 22 is sandwiched betewen first and second contoured portions 24, 24', each having a planar face 26, 26' abuttingly engaging opposite sides 28, 28' of the central lamina 22, and a convex surface 30, 30' cooperating to form the grasping surface of the handle 20. By utilizing such a laminar structure, the implement 10 can be afforded greater strength, and it will be more resistant to shearing forces which will occur at the interface between the handle 20 and paddle portion 14 as the user of the implement strikes the ball 12.

A flexible basket 32 is mounted at the second opposite end of the handle 20. The basket 32 can include a frame 34 which is manufactured from heavy gauge wire stock. In embodiments of the implement for use with a spherical projectile such as a ball, the frame 34 could be made to have a substantially circular shape. A pair of extension prongs 36 can extend from the frame 34 generally normal to a segment of the periphery of the frame 34, and parallel to one another. These prongs 36 function to mount the frame 34 to the handle 20.

In certain embodiments, the frame 34 can be permanently mounted to the handle 20 by affixing the prongs 36 within female receptacles 38 formed axially within the handle 20, by use of an epoxy or other appropriate substance. In other embodiments, however, each receptacle 38 can have an inside diameter substantially the same as the outside diameter of each of the prongs 36 so that the prongs will fit snugly within those receptacles 38, but can yet be retracted for transport and storage when the implement 10 is not in use.

The frame 34 defines the entrance to the basket 32. As with the paddle member 14 when a ball 12 is used with the implement, a circular frame would have a diameter somewhat larger than the diameter of the ball. Such relative dimensions would allow the ball to pass through the frame 34 for a purpose to be hereinafter described. In one configuration of the invention, the frame 34 can be mounted to the handle 20 so that a plane defined by the frame 34 is substantially coplanar with the closely spaced planes of the parallel planar surfaces 16, 18 of the paddle member 14.

Figure 4:
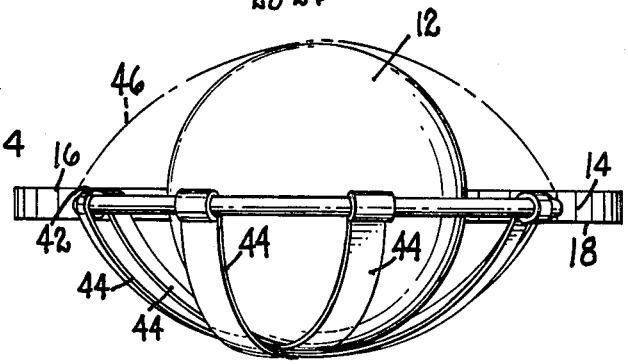
FIG. 4 is an end view showing the basket portion in one position and showing an alternative position of the basket portion in phantom lines.

The flexible basket 32 can further include a stocking member 40 attached to the frame 34. The stocking member 40 can include an entry lip 42 defined by opposite ends of a plurality of woven nylon straps 44, and is suspended from the frame 34 by this lip 42. The flexibility of the stocking member 40 permits it to pass through the frame 34 to positions on either side thereof as best illustrated in FIG. 4. The phantom line 46 in that Figure illustrates an alternative position the stocking member 40 might take on an opposite side of the frame 34.

The Figures illustrate a flexible basket 32 comprising four woven nylon straps 44. The straps 44, at their ends, define entry lip 42 by which the stocking member 40 is attached to frame 34. When frame 34 is circular in shape, the straps 44 can be similar in length so that, when stocking member 40 is extended on one side of frame 34, they extend similar distances on the side of the frame and, essentially, engage one another.

In one embodiment of the invention, a ball 12 having a diameter of approximately two inches can be used. When such a ball 12 is used, it has been found appropriate to utilize a frame 34 having a diameter of approximately five inches. With the ball 12 and frame 34 so dimensioned, the stocking member 40 can be adequately formed utilizing four nylon straps 44. The straps 44 might appropriately be ten inches in length and have a width of one inch.

In order to preclude the ball 12 from passing through stocking member 40, the straps 44 can be angularly spaced from one another, intersecting each other at portions intermediate their opposite ends and centrally within frame 34. In order to preclude angular movement of the straps 44 relative to one another, they can be secured together at their point of intersection. This can be accomplished by use of a rivet 48 or other appropriate means.

In one embodiment of the apparatus, the implement 10 can be used with a ball 12 made of a light plastic. When such a ball 12 is used, it is desirable to impart some measure of rigidity to stocking member 40 so that it can form an upwardly and forwardly extending dome, as illustrated by phantom line 46, in order that a catch of the ball 12 will be cushioned. This can be accomplished by coating straps 44 with a polyurethane type material. Such a material will not make the straps 44 sufficiently rigid so that they will not pass through the frame 34, but it will impart a degree of rigidity to cushion the catch of the ball 12.

The degree of rigidity given the stocking member 40 should be sufficient so that gravity, by itself, will not cause it to pass through frame 34. The user of the implement 10 can, thereby, position it with the dome formed by the stocking member 40 extending upwardly and generally in a direction from which the ball 12 will approach him. The implement 10 can be interposed between the user and the ball 12 so that the ball 12 will strike the dome. The engagement of the stocking member 40 by ball 12 will cause member 40 to pass through the frame 34, and ball 12 will be secured within member 40.

The paddle means 14 and flexible basket 32 are spaced along an axis and are fixed relative to one another. In the embodiment illustrated in the drawings, this is accomplished by interposing the handle 20 between these two elements with each mounted at one of the opposite ends of the handle 20. It will be understood, of course, that it is not essential that the handle 20 be so positioned. Embodiments of the invention can be configured wherein the handle 20, although still fixed relative to the other components of the structure, is displaced so that its longitudinal axis does not coincide with the axis along which the paddle means 14 and basket 32 are spaced. Because of the increased difficulty in handling of the implement 10 as a result of displacing the handle 20 from a position immediately between the paddle and basket elements 14, 32, such a configuration might be desirable in games requiring advanced skills.

Numerous characteristics and advantages of my invention have been set forth in the foregoing description. It will be understood that this disclosure is, in many respects, only illustrative. Changes may be made in details, particularly in matters of shape, size, and arrangement of parts. The scope of the invention is, of course, defined in the language of the appended claims.

OPERATION

The athletic implement 10 hereinbefore described is suitable for use in various paddle ball type games. It would be appropriate to use the implement 10 in either a game involving a single player wherein a ball 12 is impelled by the player toward a wall off which the ball 12 bounces and returns to the player, or in a game involving two players where one player receives the ball 12 and returns it to the other. In either type of game, however, the actual use of the implement 10 by a single player would be substantially the same.

As the ball 12 moves toward a player, either after bouncing off the wall or being impelled by another player, it is accepted by the player by his maneuvering the apparatus 10 so that the ball 12 passes through the frame 34 and into the stocking member 40. The player, by wrist action, flips the ball 12 out of the stocking 40 and, while it is still in the air, strikes it with the paddle portion 14 of the implement 10.

Since the stocking 40 is flexible and can relatively freely pass through the frame 34, the ball 12 can be permitted to enter into the stocking 40 by passing through the frame 34 in either direction. Without changing his grip on the handle 20, therefore, the player can receive the ball 12, flip it out of the stocking 40, and return it to the wall or an opposing player with his forearm 50 in the same position, either pronated or supinated, throughout the performance of all three motions. The pronated position of the forearm 50 is one in which the palm of the hand and the inside 52 of the forearm 50 are facing downwardly or inwardly toward the body of the player. The supinated position of the forearm 50 is one in which the palm of the hand and the inner portion of the forearm 50 are facing upwardly or outwardly away from the body of the player.

What is claimed is:

1. In combination with a ball having a specified diameter, an athletic tool, comprising:

a handle member having opposite ends;

a paddle member having a first planar surface, mounted at a first opposite end of said handle member;

a frame mounted at a second opposite end of said handle member; and a stocking member comprising a plurality of woven nylon straps, each having opposite ends and being suspended from said frame by said opposite ends, said straps being coated with a polyurethane type material to impart to them a measure of rigidity;

wherein said stocking member will tend to remain on a side of said frame on which it is initially disposed unless struck by the ball to urge it onto the other side of said frame;

and wherein, when the ball is received in said basket, said rigidity will preclude difficulty in a player impelling the ball out of said basket.

2. The tool of claim 1 wherein said frame and said first planar surface are substantially coplanar.

3. The tool of claim 2 wherein said paddle member includes a second planar surface parallel to, and facing in an opposite direction from, said first planar surface.

4. The tool of claim 1 wherein said frame is substantially circular in shape and wherein said straps are angularly spaced from one another and intersect one another intermediate said opposite ends and centrally within said frame.

5. The tool of claim 4 further comprising said ball and wherein said ball has a diameter of substantially two inches and said frame has a diameter of substantially five inches.

6. The tool of claim 5 wherein each of said straps has a length of substantially ten inches and a width of substantially one inch.

7. The tool of claim 5 wherein said ball is made of a light plastic.

* * * * *